United States Patent [19]

Simcoke

[11] Patent Number: 5,055,354

[45] Date of Patent: Oct. 8, 1991

[54] TRANSPARENTIZED PAPER AND METHOD FOR ITS MANUFACTURE

[75] Inventor: David R. Simcoke, Mt. Clemens, Mich.

[73] Assignee: Phomat Reprographics, Inc., Madison Heights, Mich.

[21] Appl. No.: 386,409

[22] Filed: Jul. 27, 1989

[51] Int. Cl.[5] ..... B32B 9/06

[52] U.S. Cl. ..... 428/342; 8/119; 427/161; 427/358; 428/499; 428/543; 428/918

[58] Field of Search ..... 427/161, 358; 428/264, 428/532.5, 342, 499, 543, 918; 8/119

[56] References Cited

U.S. PATENT DOCUMENTS

| | | | |
|---|---|---|---|
| 2,759,849 | 8/1956 | Kafig | 117/113 |
| 3,112,985 | 12/1963 | Schoppmeyer | 8/115.6 |
| 3,370,949 | 2/1968 | Groenland | 96/75 |
| 3,813,261 | 5/1974 | Muller | 427/161 X |
| 4,058,399 | 11/1977 | McNeil | 96/75 |
| 4,137,046 | 1/1979 | Koike et al. | 8/192 |
| 4,513,056 | 4/1985 | Vernois | 428/26 X |
| 4,569,888 | 2/1986 | Muller et al. | 428/264 X |

*Primary Examiner*—Michael Lusignan
*Attorney, Agent, or Firm*—Krass & Young

[57] ABSTRACT

Transparentized paper, free of residual solvent, is fabricated by coating a web of paper with a solvent-free transparentizing medium, allowing the medium to remain on the paper for a period of time sufficient to saturate part but not all of the thickness of the web, removing the excess transparentizing medium and storing the paper for a period of time sufficient to equilibrate the concentration of transparentizing medium in the thickness of the web. Also included are solvent-free transparentized papers produced by this method.

20 Claims, 2 Drawing Sheets

TRANSPARENTIZED PAPER AND METHOD FOR ITS MANUFACTURE

FIELD OF THE INVENTION

This invention relates generally to paper and more specifically to transparentized paper. Most specifically, this invention relates to a method for transparentizing paper stock without the use of solvent and to the papers produced by that method.

BACKGROUND OF THE INVENTION

Transparentized paper has been used for a long period of time in various graphic applications. Such papers have been used for manual drafting operations, graphing, chart making, engineering reproduction, photocopying and tracing. The need for transparentized drawing media is increasing as a result of new technologies such as computer-aided drafting, electrostatic-type engineering copiers and for plotters including laser plotters. As used herein, the term "transparentized paper" refers to paper rendered at least partially transparent by chemical treatment. The term "parchmentized" is also employed to refer to drawing media of this type. Drafting vellum is a high-grade paper generally manufactured with a high (often 100%) content of cotton fiber and transparentized drafting vellum is widely used for engineering, architectural and other technical drawings.

For more than 40 years, the general practice in the industry has been to transparentize paper stock by impregnating it with a transparentizing medium dissolved or dispersed in a solvent. The medium is selected to have an index of refraction approximating that of cellulose fibers and serves to fill air spaces between the fibers thereby increasing the degree of transparency of the sheet.

The amount of transparentizing medium employed must be strictly controlled in order to produce a commercially acceptable transparentized paper having consistent properties. The transparentizing medium generally comprises hydrocarbons or synthetic resins and if too much is impregnated into the paper, the paper will be overly transparent, have a greasy feel and repel ink or blur markings made thereupon. If too little medium is impregnated into the paper, then it will not have the degree of transparency its use requires. In order to precisely and consistently control the amount of medium impregnated into the paper, the industry has found it necessary to dissolve the transparentizing medium in solvent and apply it in a fairly dilute form.

Use of solvent in transparentizing operations creates problems both in the process and in the final product. The solvents employed are organic solvents and must have fairly high volatility to enable their removal. Typical solvents include aromatic such as toluene or xylene, aliphatics such as petroleum ether or kerosene as well as ketones, esters and the like. These solvents are highly flammable and their use entails specialized blast-proof coating lines and high efficiency ventilation systems. Removal of solvent residue requires that the coated paper be passed through a drying line, and this step consumes significant amounts of energy and time. Furthermore, the drying lines are generally fairly long. Removal of solvent is a time/temperature process and the upper limit on temperature is the flash point of the solvent or the temperature at which the paper is damaged. Obviously, eliminating solvent would simplify the transparentizing process and apparatus and could enhance the speed at which the product is produced.

In addition to the foregoing problems of removal, the solvents present health hazards to employees and necessitate specialized handling procedures and compliance with various governmentally mandated regulations. Solvent residues must be recovered and such recovery necessitates the use of expensive, energy intensive equipment and processes.

The use of solvent based transparentizing media also creates problems with the finished product. The heat used to remove solvent from the paper also removes water from the cellulose fibers, changing the dimensions of the paper and making it more brittle. This water must be replaced; and consequently, humidifying steps involving the use of steam chambers or long exposure to ambient humidity must be implemented, further increasing the complexity and expense of the process.

Even though rigorous drying procedures are generally implemented, the finished product includes residual solvent which slowly volatilizes. This solvent residue gives an objectionable odor to the transparentized paper and can present an actual or perceived health hazards to end users. Furthermore, residual solvent can damage any apparatus which employ such transparentized papers such as copying, folding or plotting machines or any other apparatus needed to further utilize the product. Solvent-based transparentizing processes are disclosed, for example, in U.S. Pat. Nos. 4,137,046 and 3,370,949.

Aqueous-based transparentized materials have been employed in an attempt to eliminate problems associated with organic solvents. The aqueous materials employ starch, for example, as a transparentizing medium but it has been found that the products produced thereby are less than satisfactory. Papers transparentized by the aqueous process generally have a sticky or greasy feel; or they are quite hygroscopic and manifest an uneven transparency. The water from aqueous processes can detrimentally affect the properties of the paper; for example, it can cause shrinkage or poor surface quality. Paper transparentized by this process does not meet the U.S. government standard for tracing paper (Federal Specification "Paper, Tracing, UU-P-561H" published Dec. 12, 1972), and such materials have only limited commercial utility.

Another approach to eliminating solvent has been to coat a froth of transparentizing medium and air onto a web of paper in an attempt to minimize the amount of medium deposited. This process is difficult to control and has limited commercial use and it is desirable to have a simpler, more reliable alternative. Attempts to make transparentized paper have also involved the high-pressure impregnation of paper with a molten thermoplastic resin through the use of heated rollers. This process is expensive to implement and difficult to control. The product produced thereby often has an uneven transparency and is changed in its dimensions. Such resin impregnation often renders vellum papers too brittle for most purposes.

It will thus be appreciated that there is a need for a simple, solventless method of transparentizing paper on a consistent basis so that a uniform, high quality, commercially acceptable product results. A solventless process will improve the efficiency, cost and safety of the coating operation and will eliminate solvent residue, thereby enhancing the quality of the final product. Additionally, a solventless process eliminates the need for a drying step thereby maintaining the dimensional and surface qualities of the paper intact while effecting cost savings in terms of equipment, space, time and energy.

The simple expedient of immersing a sheet of paper in an appropriate solvent-free medium is unsatisfactory since the paper, (particularly thin vellum), quickly saturates and becomes useless for most graphic applications. U.S. Pat. No. 2,759,849 discloses a process for transparentizing paper-based photographic prints, which involves immersing the prints in a near-boiling mixture of mineral oil, paraffin and surfactants. This process totally saturates the paper, giving it a greasy feel and causing it to repel inks; and therefore, is of severely limited utility. There is, accordingly, a further need for a transparentizing process which in addition to being solvent-free,, produces a transparentized paper which is not totally saturated with transparentizing medium.

According to the present invention, there is provided a solvent-free method for the preparation of transparentized papers. The method of the present invention provides for precise control of the amount of transparentizing medium applied to the paper thereby providing control of the quality of the final product. These and other advantages of the present invention will be readily apparent from the drawings, discussion, description and claims which follow.

BRIEF DESCRIPTION OF THE INVENTION

There is disclosed herein a solventless method for transparentizing paper. A generally elongated web of paper is continuously advanced and one surface of the web is contacted with a solvent-free, liquid, transparentizing medium which has a refractive index of approximately 1.4–1.5, so as to deposit a layer of the transparentizing medium onto the surface of the web. The layer is maintained on the web for a dwell time sufficient to saturate a portion, but not all, of the thickness of the web after which time excess transparentizing medium is removed. The web is then stored for a period of time sufficient to equilibrate the concentration of transparentizing medium in the saturated and unsaturated portions of web thickness. In this manner a transparentized web of paper, free of residual solvent is produced.

The transparentizing medium may be a liquid at room temperature or it may be solid, in which case it will be heated prior to coating. One preferred transparentizing medium is mineral oil.

The transparentizing medium may be advantageously employed by utilizing a fountain-type coater in conjunction with a wiper blade.

In general, it has been found that a dwell time of approximately 0.01–0.1 second is sufficient to allow the transparentizing medium to partially penetrate and saturate the thickness of the web of paper.

The present invention also includes solvent-free transparentized papers produced according to the foregoing method. Such papers comprise a body of cellulosic material impregnated with between 0.0005 and 0.002 pounds of transparentizing medium per square foot, the transparentizing medium being an organic liquid having a refractive index of approximate 1.4–1.5 and being free of volatile organic compounds.

DETAILED DESCRIPTION OF THE DRAWINGS

Figure 1A:
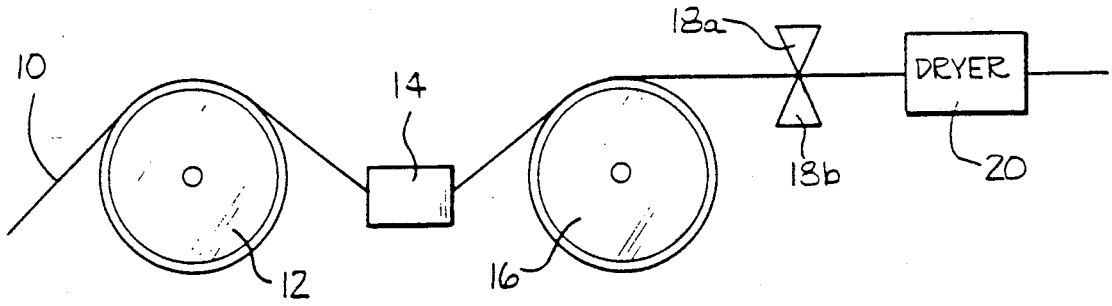
FIG. 1A PRIOR ART
FIG. 1A is a schematic depiction of one prior art system for transparentizing paper.
Figure 1B:
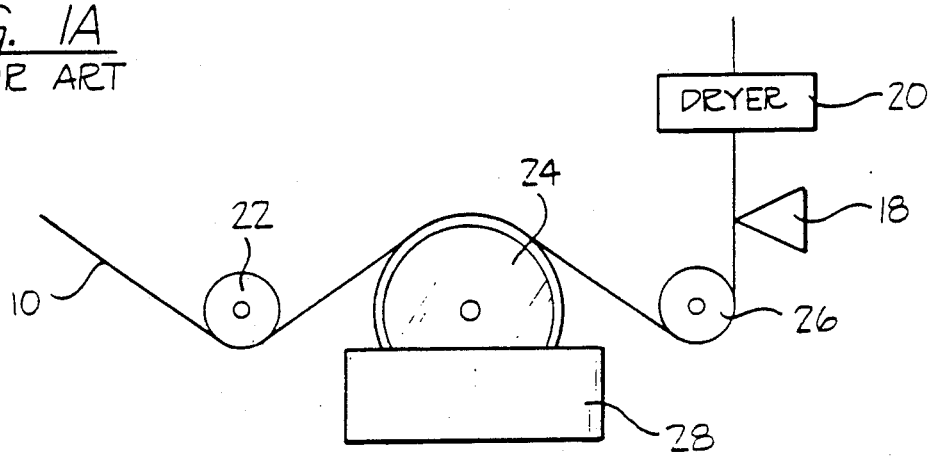
FIG. 1B PRIOR ART
FIG. 1B is a schematic depiction of another prior art process for the transparentizing of paper.

The present invention will best be understood in the context of prior art transparentizing processes and FIGS. 1A and 1B depict in schematic form, two such prior art processes.

In the process of FIG. 1A, a generally elongated web 10 of paper material is advanced through a series of work stations at speeds of typically 100 feet per minute. The web 10 is fed from a supply roll (not shown) or other such source and is directed by a first guide roller 12 into a dip coating station 14, from whence it proceeds to a second guide roller 16, to a pair of wiper blades **18*a*, 18*b* and into a dryer 20, after which the web 10** is rolled, cut or otherwise processed for storage.

In the process of FIG. 1A the web 10 is totally immersed in a transparentizing solution. One typical transparentizing solution is comprised of 20% of transparentizing medium and 80% organic solvent although other proportions may be employed depending on the nature of the paper, web speed etc. The web is totally saturated in the solution and the amount of residual transparentizing medium applied is controlled by controlling the relative proportions of medium and solvent. The wipers **18*a*, 18*b* are employed to remove excess medium-solvent solution prior to the drying of the web. Drying conditions will depend upon the particular solvent employed and the dryer station 20** will generally include exhaust means having associated scrubbers for removing solvent residues. In some instances, the drying step is not carried out immediately. The coated web is stored in what is referred to as a "wet-pack" process and is dried at a later time. A wet pack process may be carried out at web travel speeds of more than 100 feet per minute; however, the web must later be dried as mentioned previously.

FIG. 1B depicts another conventionally employed transparentizing process. In this process, a web 10 is directed by a guide roller 22, onto a coating roller 24, about a second guide roller 26, across a scraper 18 and into a drying station 20. The process of FIG. 1B differs from the process of FIG. 1A insofar as only one side of the web is coated with the solution of transparentizing medium. The solution is applied from a reservoir 28, by the coating roller 24 which dips into the transparentizing solution and applies a layer of that solution to the web as it passes thereacross. Since only one side of the web is coated with the solution, the amount of transparentizing medium dissolved in the solvent is generally higher than in the foregoing depiction. Typically, the solution comprises approximately 33% transparentizing medium in 67% solvent; although as noted previously, other proportions may be employed, depending on the particulars of the paper and the process. The drying is accomplished as in the foregoing example and web travel is approximately 100 feet per minute. The FIG. 1B embodiment may also be operated in a wet-pack mode.

Figure 2:
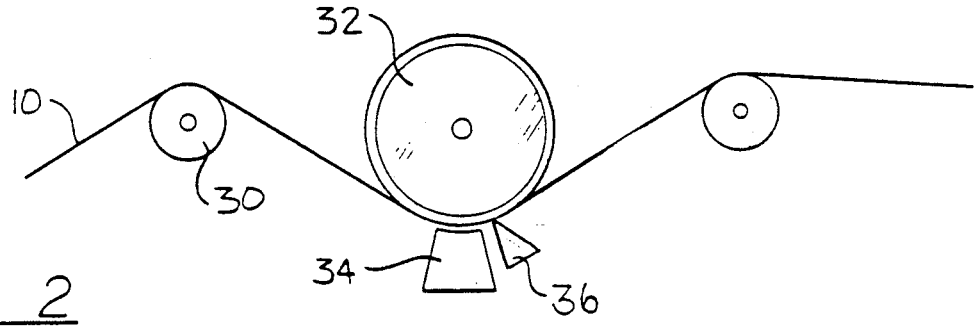
FIG. 2 is a schematic depiction of a process for transparentizing paper in accord with the principles of the present invention.

Referring now to FIG. 2, there is shown a schematic depiction of the coating process of the present invention. A notable feature of the FIG. 2 schematic depiction is the absence of a drying station. In this process, the web of paper material 10 is directed by a first guide roller 30 about a portion of the circumference of a support roller 32. A coating fountain 34 is disposed in spaced apart relationship with the support roller 32 so that the web 10 passes between the fountain 34 and the support roller 32. The coating fountain 34 is operative to deliver a stream of transparentizing material onto the adjacent surface of the web 10, as will be explained in greater detail hereinbelow.

Located downstream from the fountain 34 is a wiper blade 36. This blade 36, also called a "doctor blade" in the coating arts, is fabricated from a generally resilient material such as rubber, synthetic polymers or thin metals, and operates to remove excess transparentizing medium from the web.

As will be explained in greater detail hereinbelow, the present invention allows for ready control of the amount of transparentizing medium applied to the web and by such control, extremely small amounts may be readily applied, thereby obviating the need for dilution and subsequent solvent removal.

Control of the amount of applied medium is accomplished by regulating the speed of web travel, the distance between the coating fountain 34 and wiper blade 36, and the setting of the wiper blade 36, while taking into account the absorptivity of the particular web for the particular medium. The coating fountain floods the web with a stream of transparentizing medium and in order to regulate the amount of medium actually applied the parameters of dwell time of the coated layer of transparentizing medium on the web and the pressure of the wiper blade 36 are controlled. By "dwell time" is meant the time in which the layer of transparentizing medium deposited by the fountain 34 is in contact with the web surface prior to coming in contact with the wiper blade. Control of dwell time is advantageously accomplished by controlling the parameters of web speed and fountain-wiper blade spacing.

The precise dwell time required for properly transparentizing a web of paper will depend upon the permeability of the particular paper to the transparentizing medium employed. If the paper is of low permeability to the medium, a longer dwell time will be required; whereas, a paper which quickly imbibes the medium will require a shorter dwell time. For most commonly employed papers and transparentizing media, it has been found that a dwell time of approximately 0.01 to 0.1 second will suffice. The use of this very short dwell time is unexpected in light of prior art transparentizing processes, which maintained solvent-medium solutions in contact with the paper for far longer periods of time. Dwell times of 0.01 to 0.1 second may be achieved by controlling fountain-blade spacing over a range of approximately 2–12 inches and by controlling web speed over a range of approximately 500–3,000 feet per minute. As should be readily apparent, the present invention increases production efficiencies from 500 to 3000 percent (depending on web speed) and also provides a significant energy saving. Obviously, various other combinations of spacing and speed may be employed to achieve other desired dwell times, and the particular dwell time required in a given transparentizing process will depend on the absorptivity of the paper for the particular medium as well as the setting of the wiper blade. For most practical purposes, it has been found that blade pressures of approximately 3 to 20 psi are preferred. The angle blade contact may be varied from zero (tangential contact) to approximately 60°, with angles of 50°–55° degrees being most preferred.

Since an undiluted medium is being applied, it will generally be desirable to avoid totally saturating the thickness of the web 10. An oversaturated paper will have a greasy feel and may repel or blur imaging materials such as ink, pencil lead or toner and may also stain items with which it comes in contact. Dwell time and wiper blade pressure are selected such that a portion, but not all, of the thickness of the web 10 is saturated with the transparentizing medium.

When the web 10 leaves the wiper blade 36 only a portion of the thickness thereof is saturated with transparentizing medium. The web 10 is then stored for a period of time sufficient to equilibrate the concentration of transparentizing medium in the previously saturated and unsaturated portions of the web thickness. In this manner, a uniformly transparentized paper free of residual solvent is provided. The storage time will depend upon the particular characteristics of the paper and the transparentizing medium. However, it has been found that 24 hour storage is usually adequate. Heating of the paper during storage has been found to accelerate the process of equilibration.

Papers produced by this process, unlike those of the prior art, are characterized by a lack of any residual solvents and hence are odorless and non-toxic. It has generally been found that 0.0005 to 0.002 pounds per square foot of transparentizing medium are sufficient for imparting an appropriate degree of transparency to most papers. It should be noted that the term "solvent" may be broadly interpreted to cover any material which solvates another material. For purposes of this invention, "solvent" as used herein shall generally refer to volatile organic substances including, but not limited to alcohols, ketones and esters as well as various aromatic and aliphatic hydrocarbons employed in prior art processes. In some instances, ancillary materials such as dyes and the like are incorporated into the paper during the transparentizing process by the expedient of dissolving such materials in the transparentizing medium. Such ancillary materials may comprise or include small amounts of solvents or other volatile materials. These very small amounts (less than 2%) of solvent do not adversely affect the transparentized paper, nor do they require additional drying steps. Therefore the term "solventless" as employed herein is meant to encompass such trivial amounts of volatile materials.

Figure 3:
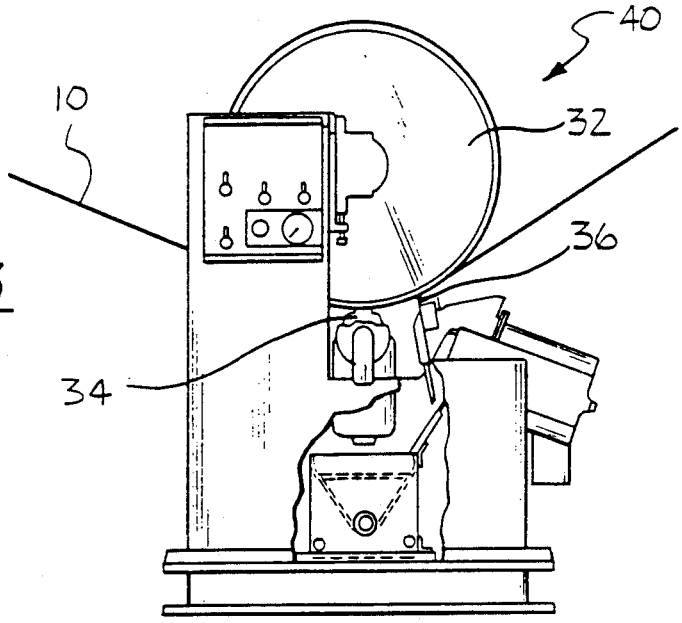
FIG. 3 is a front elevational view of a fountain coating apparatus which may be utilized in the practice of the present invention.

Referring now to FIG. 3, there is shown a front elevational view of one particular apparatus which may be advantageously employed in carrying out the present invention. The apparatus 40 of FIG. 3 includes a support roller 32, a wiper blade 36, and a coating fountain 34 as previously described. The roller 32 and fountain 34 are operative to coat a web 10 passing therethrough.

The fountain, rollers and blade are generally known and used in other industries and have been incorporated into a variety of systems and apparatus. Such components have not heretofore been employed in any combination for coating transparentizing media, particularly solvent-free transparentizing media, onto paper webs.

The various components of this apparatus are commercially available from a number of sources including the Black Clawson Corporation of Fulton, N.Y.

Figure 4:
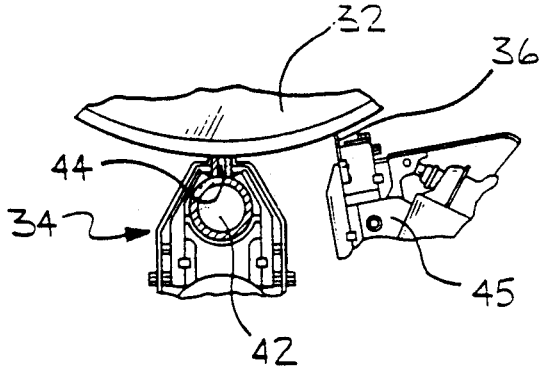
FIG. 4 is an enlarged view of the fountain and doctor blade portion of the apparatus of FIG. 3.

Referring now to FIG. 4 there is shown an enlarged fragmentary view of the apparatus 40 of FIG. 3 showing the coating fountain 34 and wiper blade 36 together with a portion of the support roller 32. The coating fountain 34 includes a coating supply manifold 42 having at least one orifice 44 in communication therewith and disposed so as to deliver a stream of material to the web surface. In operation, a pump (not shown) supplies a pressurized flow of transparentizing medium to the manifold 42, from whence it passes out of the orifice 44 and onto the surface of the web. Excess medium drains down the side of the fountain and is captured for recycle. The pump is capable of delivering up to 10 gallons per minute from a given orifice; although, in most operations, the pump is operated to provide a 2-3 gallon per minute flow from each orifice. In one particular embodiment of the present invention, the fountain includes approximately twelve orifices disposed to provide a flow of medium to a web of approximately 56 inches in width, with each orifice preferably delivering a 2-3 gallon per minute flow.

The wiper blade 36 is mounted downstream of the fountain 34 and, as shown in this embodiment, is supported by a blade holder 45. The blade is preferably fabricated from a resilient material such as rubber, synthetic polymeric materials and the like. In alternative embodiments, a flexible metal blade or an air blade may be similarly employed. The wiper blade 36 and holder 45 are configured so that the pressure with which the blade contacts the web may be adjustably controlled, typically over a range of 3-20 psi. Similarly, the holder may be configured to control the angle at which the blade contacts the web generally over a range of 0-60 degrees. Control of blade pressure and/or angle will control the amount of medium removed from the web as well as the pressure with which the medium is forced into the web. Blade pressure and angle are controlled so as to remove most of the transparentizing medium from the paper, without damaging the paper's surface. If the pressure of the blade is too low, the final loading of medium on the paper will be too high. If the pressure is too high the blade will abrade the paper. Using these subjective criteria, one of skill in the art can readily adjust the apparatus to provide optimum results.

Figure 5A:
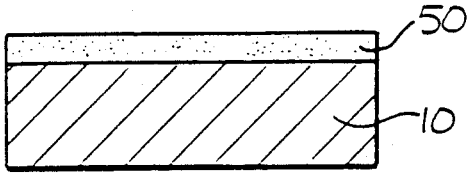
FIGS. 5A-5D are cross-sectional views of a web of paper at various stages in the transparentizing process of the present invention.

Referring now to FIGS. 5A-5D there is shown a cross section of a portion of the paper web at various stages of the transparentizing process. FIG. 5A shows the web 10 immediately upon deposit of a layer of transparentizing medium 50 thereupon. At this point, the layer of transparentizing medium 50 has not begun to penetrate the thickness of the web.

Figure 5B:
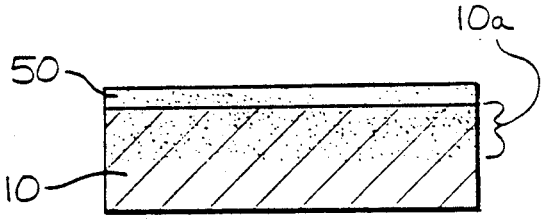
Figure 5C:
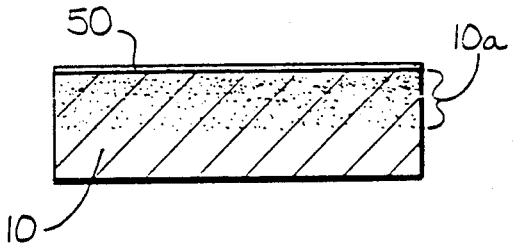

FIG. 5B shows the same web 10 at a point somewhat after application of the layer of transparentizing medium 50 but before the wiper blade has removed excess medium. It will be seen that a portion 10*a* of the thickness of the web 10 has been penetrated by the transparentizing medium and at least a very thin portion of this penetrated portion 10*a* will be saturated with the transparentizing medium. FIG. 5C shows the web 10 after removal of excess transparentizing medium by the wiper blade. At this point the portion of the thickness of the web penetrated by the transparentizing medium 10*a* has increased somewhat although the entire web thickness has not been so penetrated.

It will be noted from FIG. 5C that a very thin layer 50 of transparentizing medium remains atop the paper after contact with the blade. This thin layer of material is subsequently absorbed into the paper and equilibrated, as will be described in greater detail hereinbelow. Control of blade pressure and/or angle will control the amount of transparentizing medium remaining on the paper. Paper which is thick will generally require a thicker residual layer of transparentizing medium while thinner paper will require a thinner layer if the same degree of transparency is to be achieved. In some instances, process parameters will be such as to remove substantially all of the transparentizing medium from the surface of the web.

Figure 5D:
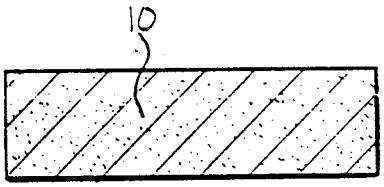

FIG. 5D depicts a cross-sectional view of the web 10 after the concentration of transparentizing medium has equilibrated through the entire web thickness. At this point, the transparentized paper is ready for use. Equilibration may take place while the paper is stored in a rolled configuration and may involve migration of the medium through the thickness of a given sheet as well as migration between superposed layers.

There are a great variety of transparentizing media which may be utilized in the practice of the present invention. In general, such materials will have a refractive index within the range of approximately 1.4-1.5 so as to match the refractive index of cellulose which is 1.45. It is further desired that the transparentizing medium be a liquid at room temperature to facilitate its application or that it be readily liquefiable by heating to moderate temperatures. In those instances where a solid transparentizing medium is employed, the coating fountain of the present invention will be modified to provide a flow of heated medium. The transparentizing medium may be a single material or may comprise a mixture of materials, provided it is substantially free of volatile components. Volatile is generally meant to refer to those materials having a vapor pressure in excess of 1 millimeter at room temperature.

Mineral oil has been found to be an excellent transparentizing medium. It is non-toxic, non-flammable, non-volatile and possesses the proper refractive index. There are many grades of mineral oil which may be employed in the practice of the present invention, however it has been found that a product sold by the Atlantic Richfield Oil Co. under the trademark Tufflo 6056 provides an excellent transparentizing medium.

The amount of transparentizing medium applied to a paper will depend upon various factors including the porosity of the paper the thickness of the paper, and the degree of transparency required in the final product. It has generally been found that loadings of approximately 1-2 lbs. per ream (144.3 sq. yds) are sufficient for most purposes. Broadly speaking, loadings of 0.0005 to 0.002 lbs. per square foot are sufficient to transparentize most paper stock.

While the foregoing description was primarily concerned with the preparation of transparentized drawing materials, it is to be kept in mind that the paper produced through the use of the present invention will find many applications. For example, the transparentized paper of the present invention provides an excellent base for various light-sensitive duplicating compositions. Diazo reprographic formulations are often applied to transparentized paper to provide intermediate copies used in a variety of duplicating applications. The base paper for such materials generally comprises 25-100% cotton, and it has been found that the present invention is ideally suited for transparentizing this material.

In light of the foregoing description, numerous variations and modifications of the present invention will be apparent to one of skill in the art. For example, there are a wide variety of transparentizing media available usable in conjunction with the present invention. Furthermore, parameters such as web speed, fountain-blade spacing, blade pressure, blade material and the like may be varied according to the particular paper web being transparentized. All of such modifications and variations of the described process are within the scope of the present invention and the foregoing drawings, discussion, description and examples are merely illustrative of particular embodiments of the present invention and not limitations on the practice thereof. It is the following claims, including all equivalents which define the scope of the invention.

I claim:

1. A solventless method for continuously transparentizing paper comprising the steps of:

continuously advancing a generally elongated web of paper;

contacting one surface of the web with a solvent-free,, liquid transparentizing medium, having a refractive index of approximately 1.4–1.5, so as to deposit a layer of the transparentizing medium onto the surface of the web;

maintaining the layer of transparentizing medium on the web for a dwell time sufficient to saturate a portion, but not all, of the thickness of the web;

removing excess transparentizing medium from the surface of the web; and storing the web for a period of time sufficient to equilibrate the concentration of transparentizing medium in the saturated and unsaturated portions of the thickness of the web; whereby a transparentized web of paper, free of residual solvent, is provided.

2. A method as in claim 1, wherein the transparentizing medium is a liquid at room temperature and the step of contacting the web with the medium comprises contacting the web with a medium maintained at room temperature.

3. A method as in claim 1, wherein the transparentizing medium is normally a solid at room temperature and the step of contacting the web with a medium includes the further step of heating the medium.

4. A method as in claim 1, wherein the step of contacting the web with a transparentizing medium comprises contacting the web with mineral oil.

5. A method as in claim 1, wherein the step of contacting one surface of the web with a transparentizing medium comprises advancing the web about a portion of the circumference of a roller and disposing a coating fountain in spaced-apart relationship with the roller so that the web passes therebetween, said fountain operative to deliver a flow of transparentizing medium to the surface of the web.

6. A method as in claim 5, wherein the step of removing the excess medium from the web comprises disposing a wiper blade in contact with the web, said blade operative to remove excess medium from the web as it passes thereacross.

7. A method as in claim 6, wherein the step of removing the excess transparentizing medium comprises disposing a wiper blade in spaced-apart relationship with the roller and downstream from the fountain so that the web passes between the blade and the roller.

8. A method as in claim 6, wherein the step of disposing the wiper blade in contact with the web comprises maintaining said blade in contact with the web at a pressure of approximately 3 to 20 psi.

9. A method as in claim 1, wherein the step of maintaining the layer of transparentizing medium comprises maintaining said layer for a dwell time of approximately 001–0.1 second.

10. A method as in claim 7 wherein the step of continuously advancing the web comprises the step of advancing said web at approximately 1,000 feet per minute and wherein the step of disposing the blade downstream of the fountain comprises disposing said blade approximately 2–12 inches downstream of the fountain.

11. A method as in claim 1, wherein the step of storing the web for a period of time comprises storing the web for at least 24 hours.

12. A method as in claim 1, wherein the step of storing the web comprises storing the web at room temperature.

13. A method as in claim 1, wherein the step of storing the web comprises storing the web at elevated temperatures.

14. A method as in claim 1, wherein the step of storing the web comprises storing the web in a rolled form.

15. A transparentized paper produced according to the process of claim 1, said paper characterized by, the absence of any volatile solvent therein.

16. A paper as in claim 15 including approximately 0.0005–0.002 $lb/ft^2$ of transparentizing medium.

17. A solventless method for continuously transparentizing paper comprising the steps of:

advancing a generally elongated web of paper at approximately 500–3,000 feet per minute;

providing a roller;

directing said web about a portion of the circumference of the roller;

disposing a coating fountain in spaced-apart relationship with the roller so that the web passes therebetween;

directing a flow of transparentizing medium having a refractive index of approximately 1.4–1.5, from said fountain onto a surface of the web so as to deposit a layer of transparentizing medium therefrom;

disposing a wiper blade approximately 2–12 inches downstream from the fountain;

contacting the coated surface of the web with the wiper blade so as to remove excess transparentizing medium therefrom so that a portion, but not all, of the thickness of the web is saturated with said medium; and storing the coated web for a period of time sufficient to allow the transparentizing medium to equilibrate throughout the thickness of the web.

18. A transparentized paper comprising:

a body of cellulosic material impregnated with between 0.0005 and 0.002 pounds of transparentizing medium per square foot, said transparentizing medium including an organic liquid having ar refractive index of approximately 1.4–1.5 and being substantially free of volatile organic compounds.

19. A transparentized paper as in claim 18, wherein said transparentizing medium is mineral oil.

20. A transparentized paper as in claim 18, wherein said transparentizing medium is free of organic compounds having a vapor pressure of more than one millimeter at 30 degrees C.

* * * * *

UNITED STATES PATENT AND TRADEMARK OFFICE

CERTIFICATE OF CORRECTION

PATENT NO. : 5,055,354

DATED : October 8, 1991

INVENTOR(S) : David R. Simcoke

It is certified that error appears in the above-identified patent and that said Letters Patent is hereby corrected as shown below:

Column 3, Line 17, Please delete "solvent free,," and insert -- solvent free, --.

Column 4, Line 57, Please delete "web is coated" and insert -- web 10 is coated --.

Column 9, Line 24, Please delete "free,," and insert -- free, --.

Column 10, Line 8, Please delete "001" and insert -- .01 --.

Column 10, Line 44, Please delete "there from" and insert -- thereupon--.

Column 10, Line 59, Please delete "ar" and insert -- a --.

Signed and Sealed this

Sixth Day of April, 1993

*Attest:*

*Attesting Officer*

STEPHEN G. KUNIN

*Acting Commissioner of Patents and Trademarks*